United States Patent [19]

Morris

[11] Patent Number: 4,703,805

[45] Date of Patent: Nov. 3, 1987

[54] EQUALIZING MEANS FOR A SUBSURFACE WELL SAFETY VALVE

[75] Inventor: Arthur J. Morris, Magnolia, Tex.

[73] Assignee: Camco, Incorporated, Houston, Tex.

[21] Appl. No.: 911,832

[22] Filed: Sep. 26, 1986

[51] Int. Cl.[4] ..... E21B 34/10

[52] U.S. Cl. ..... 166/324; 166/332

[58] Field of Search ..... 166/319, 321, 324, 332

[56] References Cited

U.S. PATENT DOCUMENTS

| | | | |
|---|---|---|---|
| 3,071,193 | 1/1963 | Raulins | 166/332 |
| 3,675,718 | 7/1972 | Kanady | 166/319 |
| 3,799,258 | 3/1974 | Tausch | 166/72 |
| 3,845,818 | 11/1974 | Deaton | 166/324 |
| 4,007,798 | 2/1977 | Gazda | 175/297 |
| 4,161,219 | 7/1979 | Pringle | 166/324 |
| 4,325,431 | 4/1982 | Akkerman . | |
| 4,454,913 | 6/1984 | Guidry et al. . | |
| 4,552,219 | 11/1985 | Wong | 166/321 |
| 4,597,445 | 7/1986 | Knox | 166/319 |
| 4,629,002 | 12/1986 | Pringle | 166/324 |

*Primary Examiner*—Stephen J. Novosad
*Assistant Examiner*—Terry Lee Melius
*Attorney, Agent, or Firm*—Fulbright & Jaworski

[57] ABSTRACT

A subsurface well safety valve having an equalizing line between a point below the safety valve and a point above the safety valve and an equalizing valve in the line. A sleeve valve is releasably locked in a first position opening the equalizing line and in a second position closing the equalizing line for protecting the equalizing valve or closing the equalizing line in the event the equalizing valve develops a leak.

5 Claims, 5 Drawing Figures

EQUALIZING MEANS FOR A SUBSURFACE WELL SAFETY VALVE

BACKGROUND OF THE INVENTION

It is known as disclosed in U.S. Pat. Nos. 4,325,431, 4,454,913; and copending patent application Ser. No. 789,234 filed Oct. 18, 1985, and owned by the assignee of the present application, to use a hydraulically actuated equalizing valve for equalizing the pressure above and below a subsurface safety valve prior to opening the safety valve. While this protects the main valve in the subsurface safety valve, the equalizing valve is subject to failure as a result of erosion and flow cutting of the equalizing valve element and seat and the equalizing valve element is subject to damage when various well treatment processes, such as well fracturing operations, are performed in the well.

The present invention is directed to a subsurface safety valve having an equalizing passageway or line and valve in which an additional valve is provided, which is normally opened, to be closed to protect the equalizing valve. Such a valve increases the life and dependability of the equalizing valve and provides a means for allowing the safety valve to fully shut off well production flow and thus perform its intended function even in the event that the equalizing valve fails.

SUMMARY

The present invention is directed to a subsurface well safety valve having a housing including a bore. A first valve in the housing is movable between an open and closed position for controlling flow through the bore and a flow tube is telescopically movable in the housing for controlling the opening and closing of the first valve. Means are provided in the housing for moving the flow tube. An equalizing passageway or line having an upper and a lower end is in communication with the bore of the housing. The lower end is in communication with the bore below the first valve and the upper end is in communication with the bore above the first valve. An equalizing valve is provided in the line which is opened prior to the opening of the first valve. A second valve is movably positioned in the housing adjacent to the upper end of the equalizing line and the second valve is normally positioned to open the equalizing line, but is movable for closing the equalizing line.

Still a further object of the present invention is wherein the second valve is a sleeve valve including releasable locking means for releasably holding the sleeve valve in a first position opening the equalizing line and in a second position closing the equalizing line. The sleeve valve includes first and second spaced seals engaging the housing and adapted to be positioned on opposite sides of the upper end of the equalizing line when the sleeve valve is in the closed position.

Yet a still further object of the present invention is the provision of actuating means on the sleeve valve for moving the sleeve valve between a position opening and closing the equalizing passageway or line.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
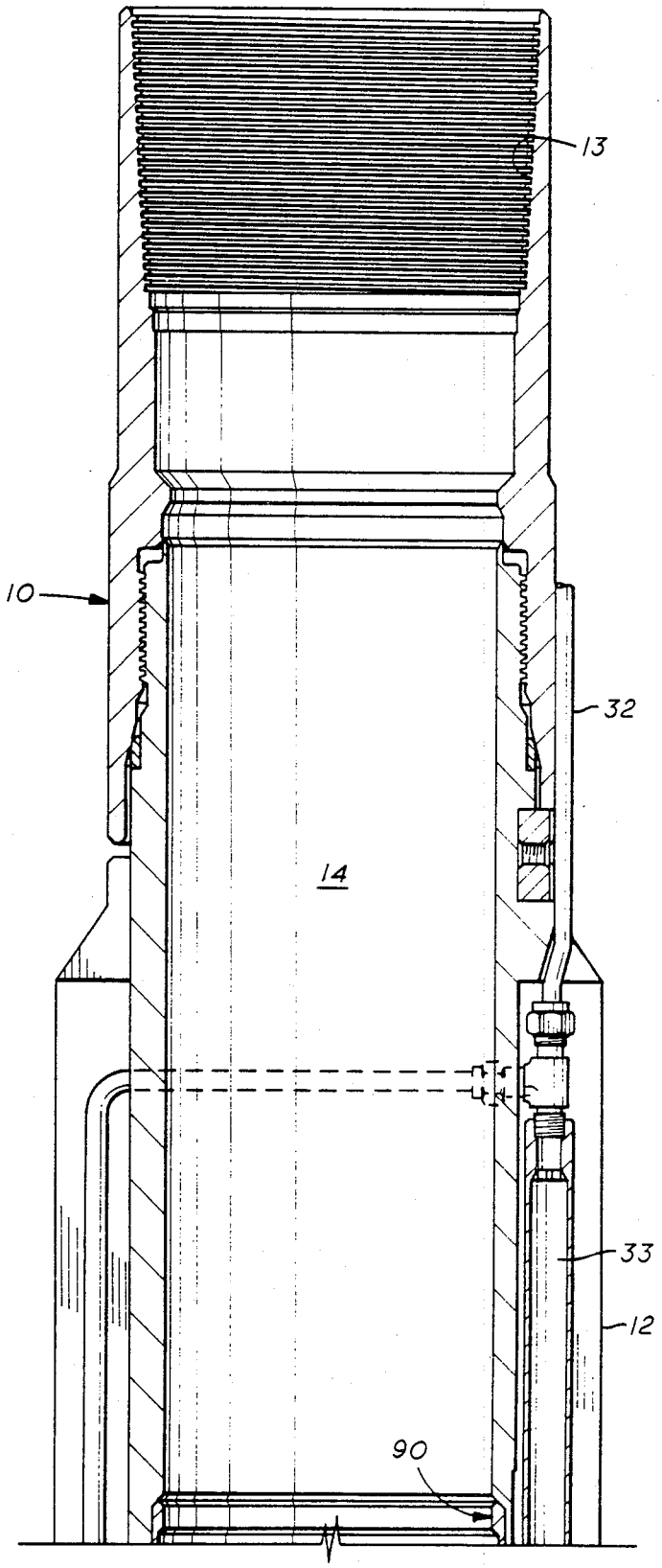
FIGS. 1A, 1B, 1C, 1D and 1E are continuations of each other and form an elevational view, in cross section of a subsurface well safety valve utilizing the present invention.

While the present improvement of an equalizing valve system for use in a subsurface safety valve will be described in connection, for purposes of illustration only, as incorporated in a flapper-type tubing retrievable safety valve, it will be understood that the present equalizing system may be used with other types of subsurface safety valves.

Referring now to the drawings, the subsurface safety valve of the present invention is generally indicated by the reference numeral 10 for connection in a well conduit or tubing (not shown) such as by a threaded box 13 at one end and a threaded pin 15 at the other end. The safety valve 10 generally includes a body or housing 12 to permit well production therethrough under normal operating conditions but in which the safety valve 10 may close or be closed in response to abnormal conditions.

Figure 1B:
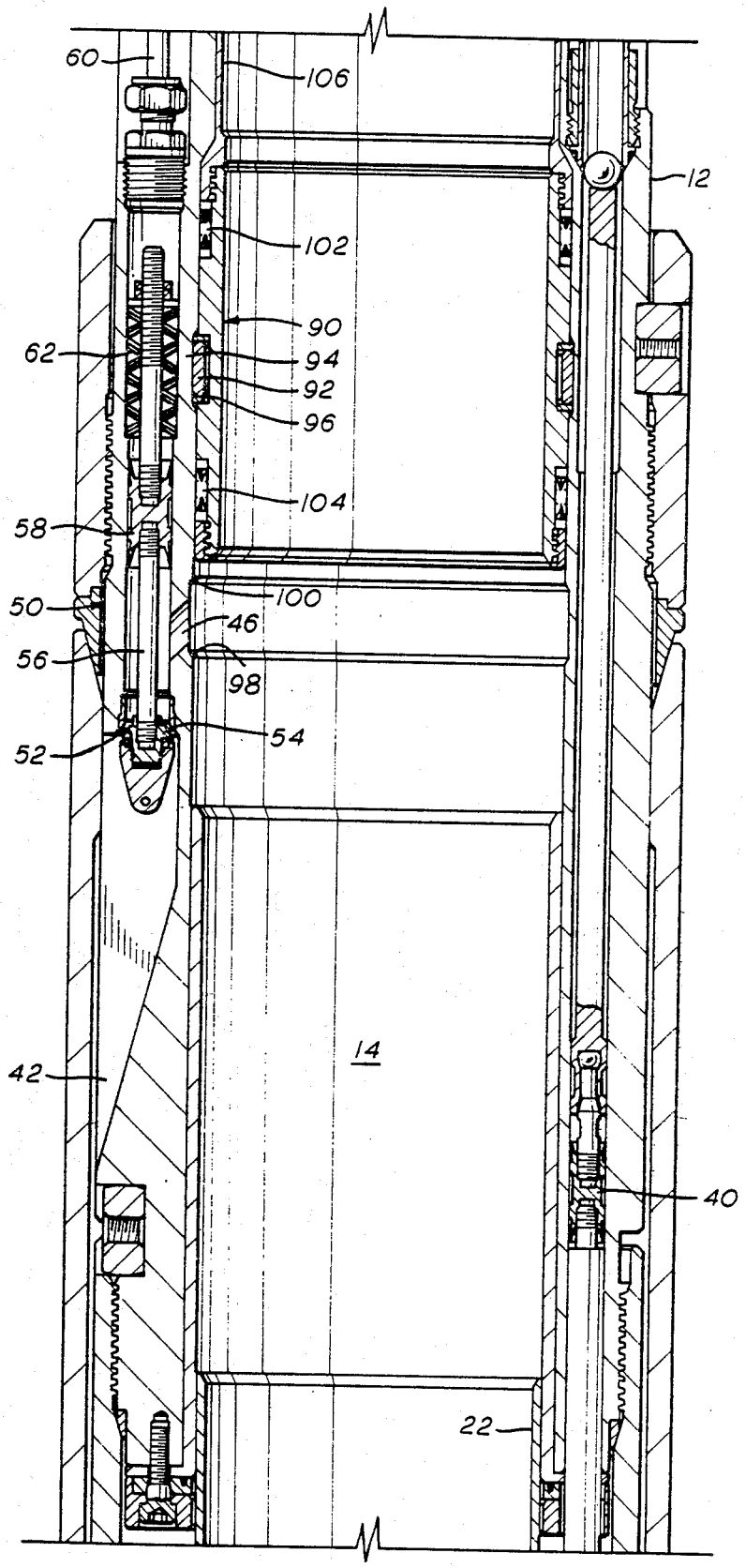

The safety valve 10 generally includes a bore 14, an annular valve seat 16 (FIG. 1E), a valve closure element such as flapper valve 18 connected to the body 12 by a pivot pin 20. A flow tube 22 is telescopically movable in the body 12 and through the valve seat 16. As best seen in FIG. 1E, when the flow tube 22 is moved to a downward position, the tube 22 pushes the flapper 18 away from the valve seat 16. Thus the valve 10 is held in the open position so long as the flow tube 22 is in the downward position. When the flow tube 22 is moved upwardly, the flapper 18 is allowed to move upwardly onto the seat 16 by the action of a spring 24.

Various means are provided to act upon the flow tube 22 to control the opening and closing of the flapper 18. Thus, biasing means, such as a spring 26, may act between a shoulder 28 on the valve body 12 and a shoulder 30 connected to the flow tube 22 for yieldably urging the flow tube 22 in an upward direction to release the flapper 18 for closing the valve 10. The valve 10 is controlled by the application or removal of a pressurized fluid, such as hydraulic fluid, through a control path or line, such as control line 32 (FIG. 1A), extending to the well surface or the casing annulus for supplying a pressurized hydraulic fluid to passageway 33 and to the top of one or more pistons 40 which in turn act on the flow tube 22 to move the flow tube downwardly forcing the flapper 18 off of the seat 16 and into the full open position. If the fluid pressure in the conduit 32 is reduced sufficiently relative to the forces urging the flow tube 22 upwardly, the flow tube 22 will be moved upwardly beyond the seat 16 allowing the valve 10 to close.

The above description of one type of subsurface safety valve is generally disclosed in U.S. Pat. No. 4,161,219.

Once the valve 10 is closed with the flapper valve element 18 seated on the seat 16 it is usual that there is a greater existing pressure in the bore 14 below the flapper 18 than above the flapper 18. This holds the flapper 18 seated with a high differential pressure and it is therefore desirable to equalize the pressure across the flapper 18 before reopening in order to be able to open the flapper against the differential pressure and to prevent the high velocities of fluid flow through the opening flapper 18 in the valve seat 16 from being damaged by erosion. Therefore, it is conventional to utilize an equalizing valve which is opened prior to the opening of the first valve or flapper 18 to equalize pressure across the flapper 18. However, the equalizing valve itself may fail as the result of the fluid flow erosion due to high velocity flow and/or high pressure for an extended period of time.

Referring now to FIGS. 1B, 1C, 1D, and 1E, one or more equalizing passageways or lines 42 and equalizing valves, preferably two, are provided in the housing 12 having a lower end 44 in communication with the space below the valve seat 16 and an upper end extending through port 46 into the upper portion of the bore 14 above the valve seat 16. Thus when the equalizing line 42 is opened fluid may flow from below the first valve consisting of the flapper 18 and valve seat 16 (when the flapper 18 is closed as will be more fully described hereinafter) and up through the port 46 and into the bore 14 above the flapper 18.

An equalizing valve generally indicated by the reference numeral 50 is provided in each equalizing line 42 and consists of a valve seat 52 and a valve element 54. When the valve element 54 is seated on the seat 52 the equalizing line 42 is closed. An actuating stem 56 is connected to the valve element 54 and to a piston 58 which is exposed on its top side to hydraulic control pressure leading to the well surface such as being in communication with a passageway 60 which in turn is in communication with the conduit 32 and fluid passageway 33 to the piston 40. However the piston 58 may be in communication with a separate hydraulic control line to the well surface. Therefore, the application of hydraulic pressure to the top of the piston 58 acts in a direction to move the valve element 54 off of the seat 52 and open the equalizing valve. The equalizing valve 50 is biased to a closed position by a spring 62.

Figure 1C:
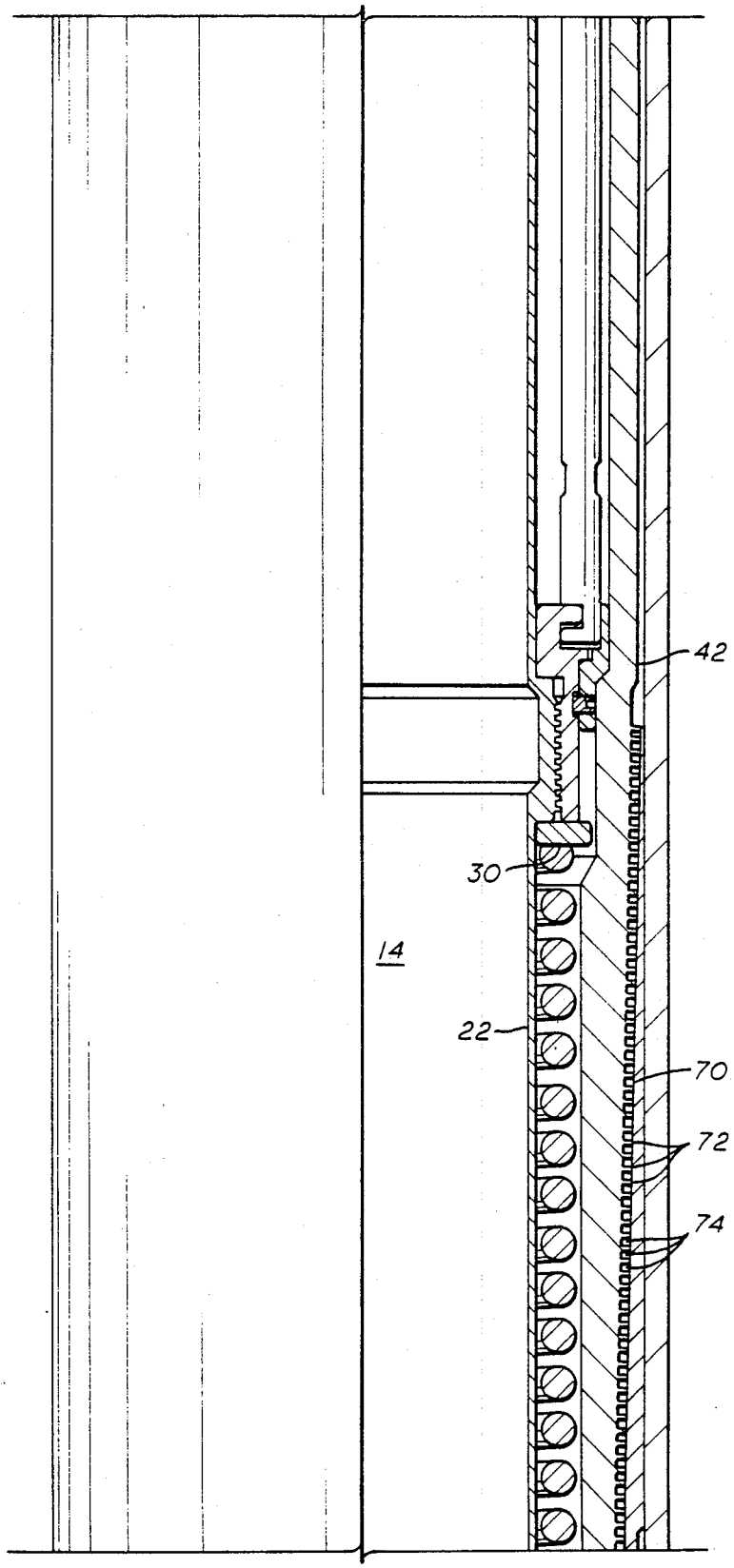
Figure 1D:
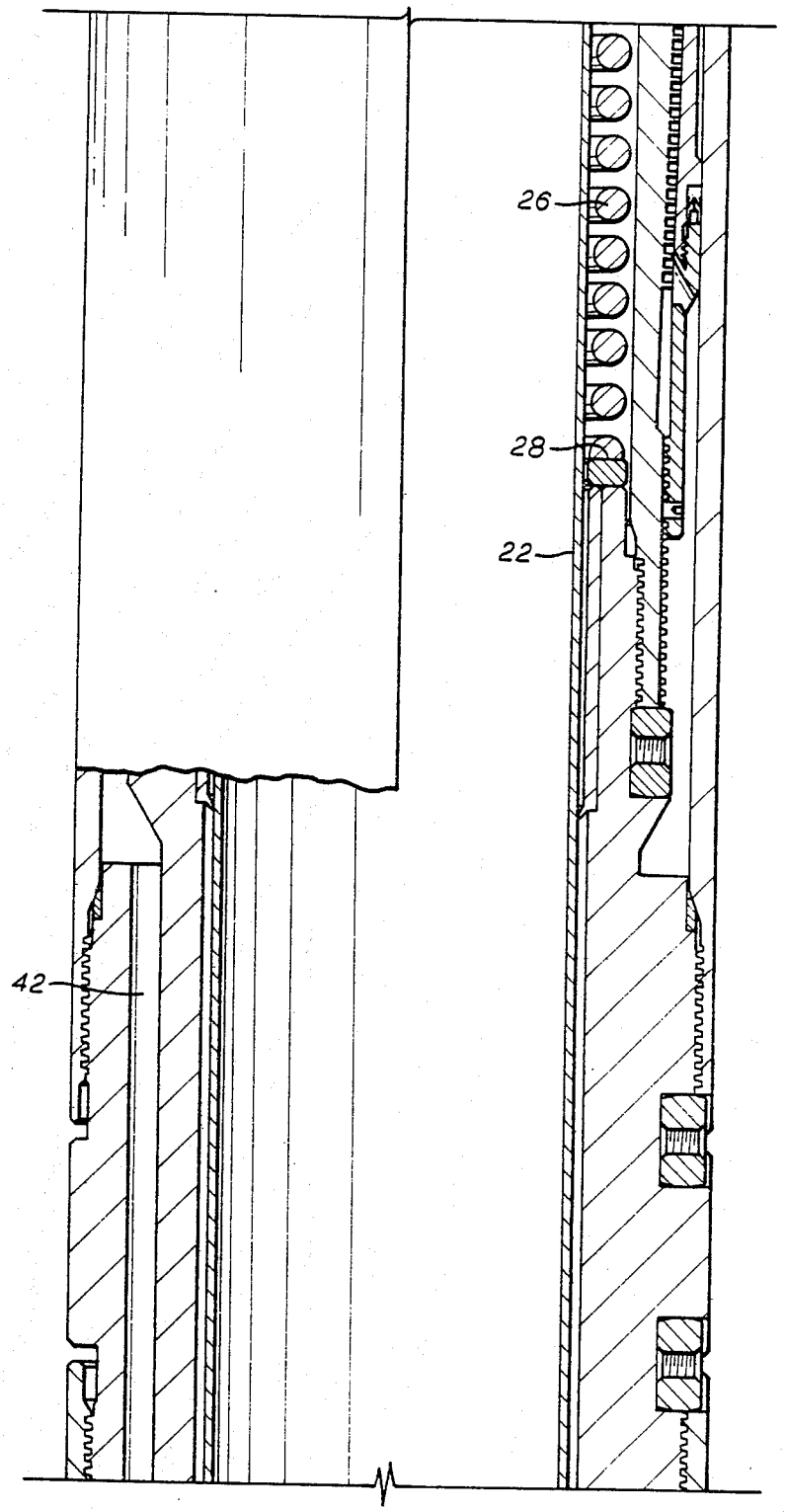
Figure 1E:
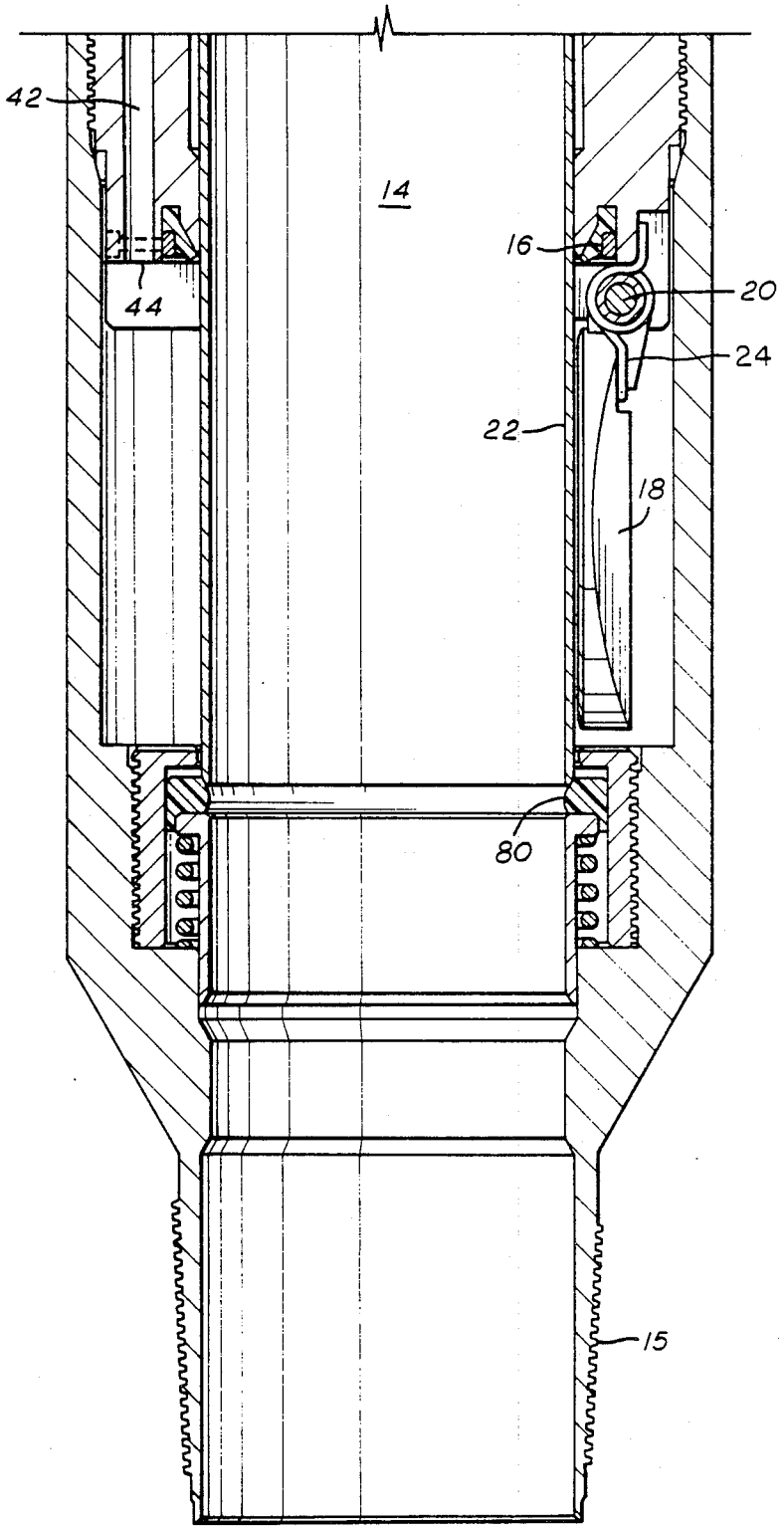

Referring now to FIGS. 1C and 1D, the equalizing passageway line 42 may include a labyrinth passageway 70 for creating control pressure drops along the equalizing line 42 to reduce the pressure and flow velocity through the equalizing line 42 to minimize the flow cutting and erosion of the equalizing valve element 54 and seat 52 thereby increasing the life of the equalizing valve 50. While the labyrinth passageway may be of any suitable undultory passageway which offers resistance to fluid flow the preferred form is an alternate series of ridges 72 and grooves 74 which extend along the equalizing line 42 and are positioned upstream of the equalizing line 42 and are positioned upstream of the equalizing valve 50. For example only, while the pressure of the well fluid at the lower end of the equalizing line 42 at end 44 is 5,000 psi, by the provision of the multiple pressure drops across the plurality of grooves 74 and ridges 72 the pressure could be dropped to any desired amount, such as, for example, 200 psi, and slowing the velocity of the equalizing fluid flowing through the equalizing line 42 thereby preventing high velocity fluid flow through the valve 50. The clearance of the ridges 72 from the outer wall may suitably be from ten to twenty thousands of an inch. The length of the labyrinth passageway 70 may be made to accommodate the particular pressures involved in the well.

Referring now to FIG. 1E, it is also noted that a resilient lower seal 80 is provided in the path of travel of the flow tube 22 so as to engage the flow tube 22 when the valve 10 is in the open position. This allows the flow tube 22 to act as a barrier between the equaling line 42 and the bore 14 when the valve 10 is in the open position thereby preventing fluid flow through the equalizing line 42, again for the purpose of limiting erosion in the equalizing means.

However, safety valve frequently remain in oil and/or gas wells for many years. During such extended periods of time the equalizing valve 50 may be damaged as a result of erosion and flow cutting of the valve seat 52 and valve element 54. That is, the passage of well production fluids through the equalizing line 42 and valve 50, which may contain sand and other abrasive materials, may damage the valve 50 causing it to leak. Additionally, oil and/or gas wells are sometimes subjected to various well treatments such as fracturing operations which may include the injection of abrasive materials down through the bore 14 for treatment of the well. Such abrasive materials may also damage the valve 50. Since a safety valve is protective device for shuting off the flow of well production fluids in the event of an emergency, a leaking equalizing valve would defeat the sole function of the safety valve.

Referring now to FIG. 1A and 1B the present invention is directed to providing a valve generally indicated by the reference numeral 90 in the bore 14 of the housing 12 adjacent the upper end of the equalizing line 42 and port 46. The valve 90 is normally positioned to open the equalizing port 46 and line 42 but is movable for closing the equalizing line 42 and port 46 for protecting the valve 50 or for closing the equalizing line 42 in the event that the equalizing system develops a leak.

The valve 90 is preferaby a sleeve valve which is telescopically movable in the bore 14 and includes releaseable locking means for releasably holding the sleeve valve 90 in a first position opening the port 46 or a second position closing the port 46. The releasable locking means may include a spring collet 92 which in the first position engages a recess 94 in the interior of the housing 12. The recess 94 includes a bevel edge 96 for allowing the sleeve valve 90 to be moved to a second position closing the port 46. In the second position the spring collet 92 engages a recess 98 in the interior housing 12 which includes an upper beveled edge 100. The sleeve valve 90 includes a first seal 102 and a second spaced seal 104 sealingly engaging the interior of the housing 12 and is adapted to be positioned on opposite sides of the port 46 when moved to the second position forclosing the equalizing line 42.

The sleeve 90 includes an actuating means such a recess 106 for engagement with a conventional well tool for mechanically hydraulically or electrically moving the sleeve 90 between a position opening and a position closing the port 46.

In operation, when it is desired to open the valve 10, hydraulic control pressure is applied to the control line 32 and passageways 33 and 60. With the flapper 18 in the closed position, the fluid forces and spring forces on the equalizing valve 50 are adjusted to cause the equalizing valve 50 to open prior to and at a lower hydraulic control pressure than the movement of the piston 40 to cause the flapper 18 to open. This allows equalizing of the pressure across the closed flapper 18. During this time, the labyrinth passageway 70 creates a plurality of pressure drops along the passageway 70 to reduce the velocity of fluid flow through the valve seat 52 and around the valve element 54 thereby reducing erosion. While the equalizing time may be longer than usual, the time may be adjusted by varying the length of the labyrinth passageway 70 to optimize the time of operation as a function of the desire pressure drop and fluid velocities.

After the valve 10 has been suitably equalized, additional fluid pressure from the control line 32 will act upon the piston 40 to move the flow tube 22 downwardly to move the flapper 18 off of the seat 16 thereby opening the valve. The flapper 22 will move downwardly and engage the lower seal 80 thereby blocking the lower end 44 of the equalizing line 42 from the well bore 14 thereby preventing fluid flow through the equalizing means while the valve 10 is open. When it is desired to close the valve 10, the hydraulic control pressure in the line 32 is reduced and the valve 50 has been adjusted to insure that the equalizing valve 50 closes before the flapper 18 begins to close thereby limiting the fluid flow through the open equalizing valve 50 as the main valve closes.

Normally, the sleeve valve 90 is positioned in the upper position opening the port 46 and the equalizing line 42 thereby allowing operation of the equalizing system. In the event that well operations are performed which might damage the equalizing valve 50, the sleeve 90 is moved downwardly closing the port 46 to protect the equalizing valve 50. After the well operations are complete, the sleeve valve 90 is again moved to its first position opening the port 46. Also, in the event that the equalizing valve 50 leaks, the sleeve 90 is moved to the downward or closed position for allowing the safety valve 10 to completely shut off well production flow through the well bore 14.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A subsurface well safety valve comprising, a housing having a bore, a first valve in the housing movable between an open and closed position for controlling flow through the bore, a flow tube telescopically movable in the housing for controlling the opening and closing of said first valve, hydraulic piston and cylinder means in the housing adapted to be in communication with the well surface contacting and moving the flow tube for opening and closing the first valve, an equalizing passageway having an upper and a lower end in communication with the bore of said housing, said lower end in communication with the bore below the first valve and said upper end in communication with the bore above the first valve, an equalizing valve in said passageway, said equalizing valve opening prior to the opening of the first valve, and a second valve movably positioned in the housing adjacent the upper end of the equalizing passageway, said second valve normally positioned to open communication of the upper end of the equalizing passageway with the bore, but movable for closing communication of the upper end of the equalizing passageway with the bore.

2. The apparatus of claim 1 wherein the second valve is a sleeve valve.

3. The apparatus of claim 2 including releasable locking means for releasably holding the sleeve valve in a first position opening the equalizing passageway and in a second position closing the equalizing passageway.

4. The apparatus of claim 2 wherein the sleeve valve including first and second spaced seals engaging the housing and adapted to be positioned on opposite sides of the upper end of the equalizing passageway when the sleeve valve is in the closed position.

5. A subsurface well safety valve comprising, a housing having a bore, a first valve in the housing being movable between an open and closed position for controlling flow through the bore, a flow tube telescopically movable in the housing for controlling the opening and closing of said first valve, hydraulic piston and cylinder means in the housing adapted to be in communication with the well surface contacting and moving the flow tube for opening and closing the first valve, an equalizing line having an upper end and a lower end in communication with the bore of the housing, said lower end in communication with the bore below the first valve and the upper end in communication with the bore above the first valve, an equalizing valve in said line, said equalizing valve opening prior to the opening of the first valve, a resilient seal in said housing in position for engagement by the flow tube in its open position for blocking fluid flow through the equalizing line, and a sleeve valve telescopically movable in the housing adjacent the upper end of the equalizing line, said sleeve valve including releasable locking means for releasably holding the sleeve valve in a first position opening communication of the upper end of the equalizing line and the bore and in a second position closing communication of the upper end of the equalizing line and the bore, said sleeve valve including first and second spaced seals engaging the housing and adapted to be positioned on opposite sides of the upper end of the equalizing line when the sleeve valve closes the equalizing line, and actuating means on the sleeve valve for moving the sleeve valve between a position opening and closing said equalizing line.

* * * * *